US005294159A

United States Patent [19]

Corrigan

[11] Patent Number: 5,294,159

[45] Date of Patent: Mar. 15, 1994

[54] SLIDING DOOR LOCK APPARATUS

[76] Inventor: Gavin J. Corrigan, 2225 N. Broadway #F, Santa Ana, Calif. 92706

[21] Appl. No.: 72,076

[22] Filed: Jun. 7, 1993

[51] Int. Cl.[5] ..... E05C 17/32

[52] U.S. Cl. ..... 292/258; 292/DIG. 46; 292/263; 292/339

[58] Field of Search ..... 292/258, 288, 259, 262, 292/263, 338, 339, DIG. 46

[56] References Cited

U.S. PATENT DOCUMENTS

| | | | |
|---|---|---|---|
| 3,255,725 | 6/1966 | Von Kreidner et al. | 292/338 X |
| 3,563,592 | 2/1971 | Preston | 292/263 |
| 3,724,130 | 4/1973 | Bogue | 292/259 X |
| 4,302,038 | 11/1981 | Ervine | 292/DIG. 46 X |
| 4,572,557 | 2/1986 | Taylor | 292/DIG. 46 X |
| 4,826,225 | 5/1989 | Styles | 292/DIG. 46 X |
| 5,127,689 | 7/1992 | Jarvis | 292/DIG. 46 X |

*Primary Examiner*—Richard E. Moore
*Attorney, Agent, or Firm*—Leon Gilden

[57] ABSTRACT

A base lock includes pivotal first and second legs that respectively are mounted to first and second pivot blocks. The first and second pivot blocks include respective third and fourth legs that are arranged for engagement between one another, with the first and second pivot blocks mounted between a sliding door frame and a sliding door.

4 Claims, 4 Drawing Sheets

SLIDING DOOR LOCK APPARATUS

BACKGROUND OF THE INVENTION

1. Field of the Invention

The field of invention relates to sliding door lock apparatus, and more particularly pertains to a new and improved sliding door lock apparatus arranged for positioning within a sliding door framework between the framework and an associated sliding door.

2. Description of the Prior Art

Sliding door locks of various types have been utilized throughout the prior art and exemplified by the U.S. Pat. Nos. 3,499,675; 5,018,373; 4,563,885; 3,698,754; and 4,993,761.

The instant invention attempts to overcome deficiencies of the prior art by providing for a sliding door structure arranged for ease of mounting and positioning within a sliding door framework and in this respect, the present invention substantially fulfills this need.

SUMMARY OF THE INVENTION

In view of the foregoing disadvantages inherent in the known types of sliding door lock apparatus now present in the prior art, the present invention provides a sliding door lock apparatus including a triangulated framework separably secured relative to one another to permit mounting within a door framework. As such, the general purpose of the present invention, which will be described subsequently in greater detail, is to provide a new and improved sliding door lock apparatus which has all the advantages of the prior art sliding door lock apparatus and none of the disadvantages.

To attain this, the present invention provides a base lock including pivotal first and second legs that respectively are mounted to first and second pivot blocks. The first and second pivot blocks include respective third and fourth legs that are arranged for engagement between one another, with the first and second pivot blocks mounted between a sliding door frame and a sliding door.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved sliding door lock apparatus which has all the advantages of the prior art sliding door lock apparatus and none of the disadvantages.

It is another object of the present invention to provide a new and improved sliding door lock apparatus which may be easily and efficiently manufactured and marketed.

It is a further object of the present invention to provide a new and improved sliding door lock apparatus which is of a durable and reliable construction.

An even further object of the present invention is to provide a new and improved sliding door lock apparatus which is susceptible of a low cost of manufacture with regard to both materials and labor, and which accordingly is then susceptible of low prices of sale to the consuming public, thereby making such sliding door lock apparatus economically available to the buying public.

Still yet another object of the present invention is to provide a new and improved sliding door lock apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
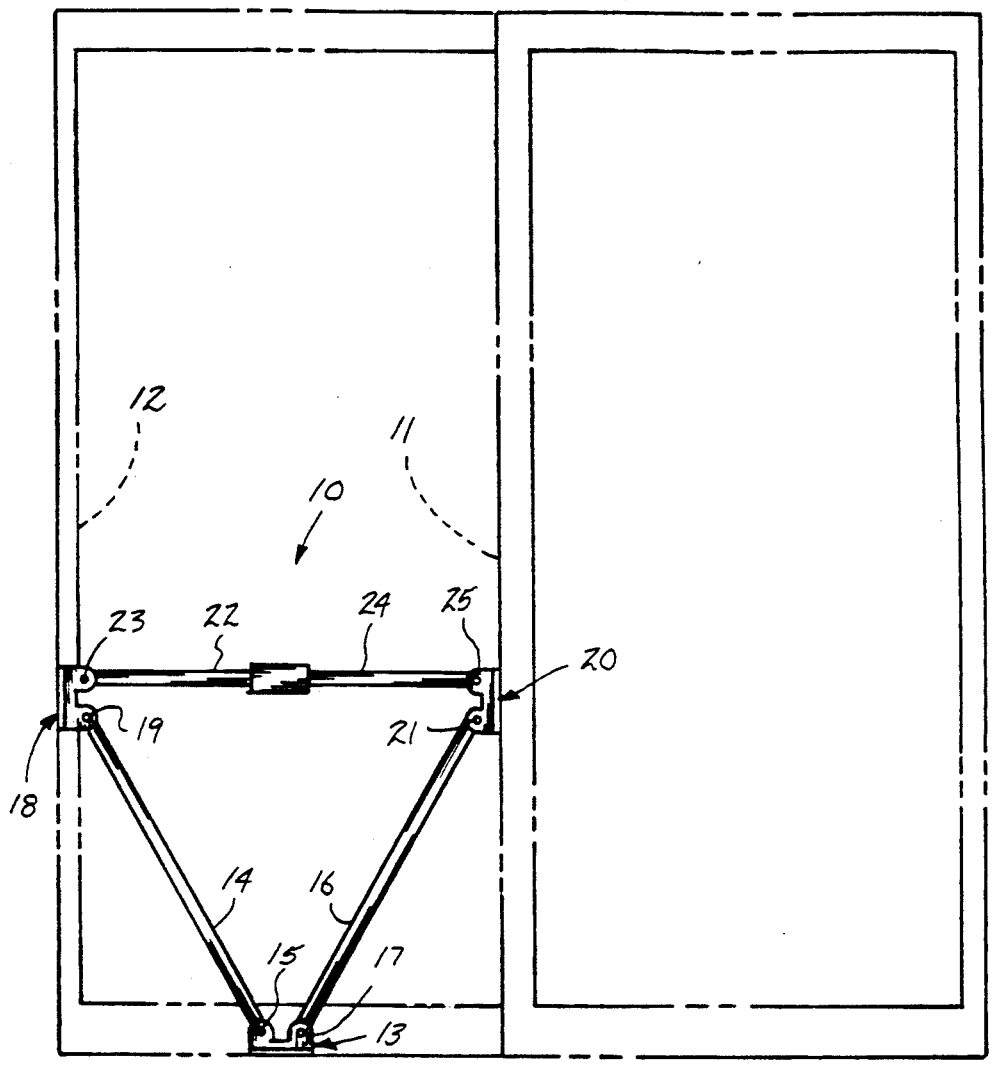
FIG. 1 is an orthographic view of the invention.
Figure 2:
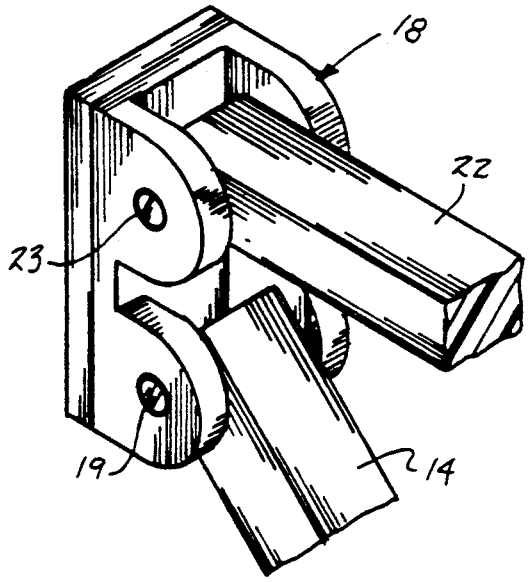
FIG. 2 is an enlarged isometric illustration of a pivot block structure.
Figure 3:
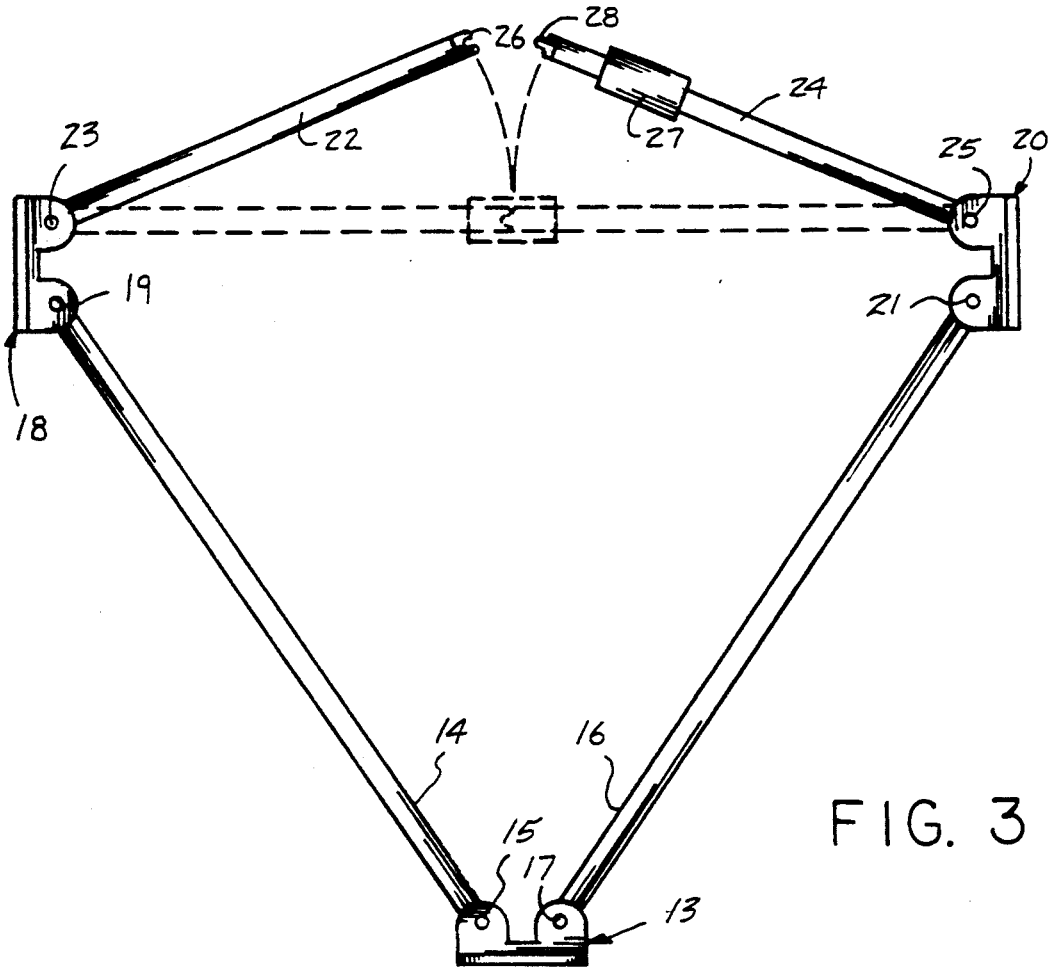
FIG. 3 is an orthographic view of the invention prior to latching.
Figure 4:
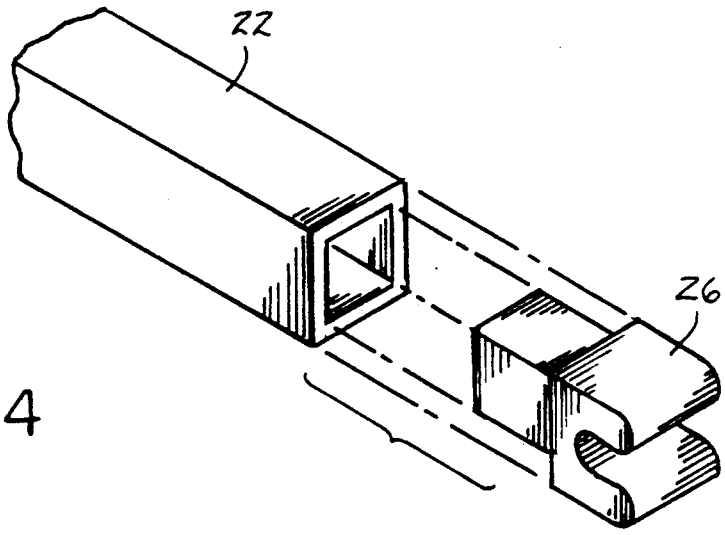
FIG. 4 is an isometric illustration of the bifurcated head structure of the third leg of the invention.
Figure 5:
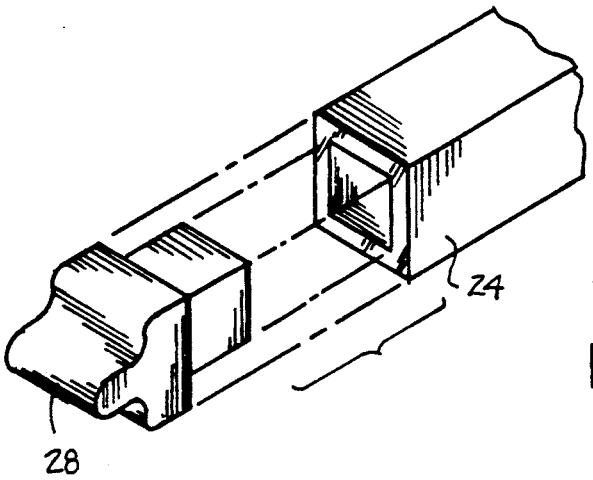
FIG. 5 is an isometric illustration of the rib member of the fourth leg of the invention.

With reference now to the drawings, and in particular to FIGS. 1 to 8 thereof, a new and improved sliding door lock apparatus embodying the principles and concepts of the present invention and generally designated by the reference numeral 10 will be described.

Figure 6:
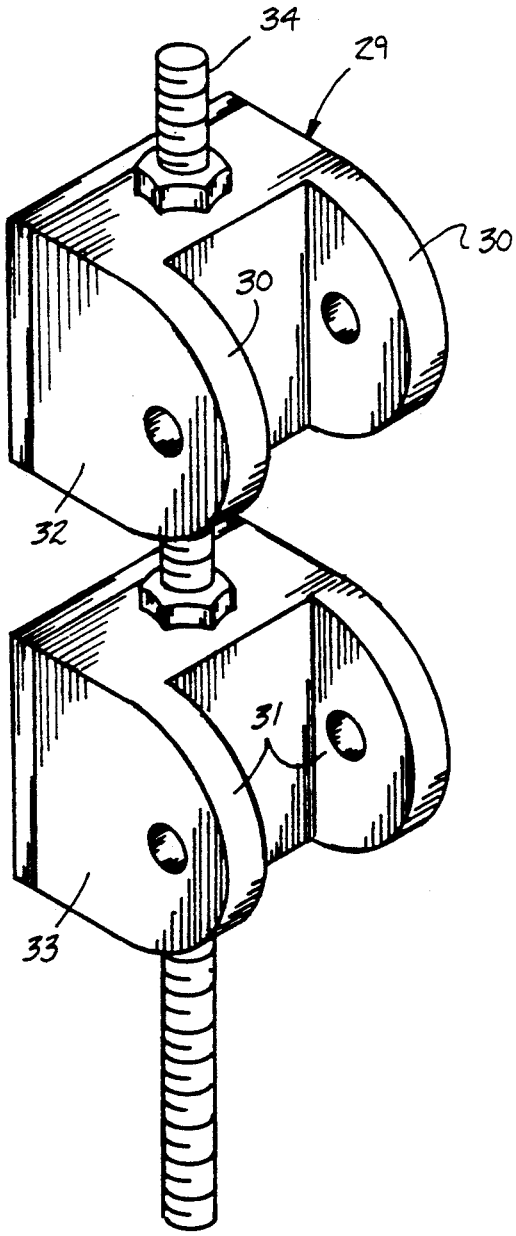
FIG. 6 is an isometric illustration of a modified pivot block assembly.

More specifically, the sliding door lock apparatus 10 of the instant invention essentially comprises mounting within a sliding door frame 12 between the frame 12 and an associated sliding door member 11. The apparatus 10 is arranged when in a latched configuration to form a triangular framework between the sliding door frame and the sliding door member. To this end, a base block 13 is provided, having respective first and second legs 14 and 16 pivotally mounted thereto about respective first and second leg first axles 15 and 17, with the first and second leg first axles 15 and 17 oriented in a parallel coextensive relationship relative to one another within the base block 13. A first pivot block 18 is provided pivotally mounted to the first leg 14 at a first leg second axle 19 at a second end of the first leg, with a second pivot block 20 provided pivotally mounted to the second leg at its second end about a second leg second axle 21. As indicated, the first and second legs 14 and 16 are of an equal length. A third leg 22 is pivotally mounted to the first pivot block about a third leg axle 23, with a fourth leg 24 pivotally mounted to the second pivot block 20 about a fourth leg axle 25. The third leg axle 23 is mounted at the third leg first end, with the fourth leg axle mounted to the fourth leg first end. A bifurcated head 26 is fixedly mounted to the third leg second end for reception of a fourth leg projecting rib 28 mounted to the fourth leg second end. A slide tube 27 slidably mounted about the fourth leg is arranged to slidably encompass the bifurcated head and the projecting rib 28 when in an interlocking configuration relative to one another, as indicated in phantom in FIG. 3. The FIG. 7 indicates the use of modified first and second pivot blocks 29 and 29*a* in lieu of the first and second pivot blocks 18 and 20. Construction of the pivot blocks are of identical configuration, of a type as indicated in FIG. 6, wherein respective first and second heads 32 and 33 are mounted in an adjustable relationship threadedly receiving a first adjuster rod 34 therethrough, with the first and second heads having respective first and second flange pairs 30 and 31, with the first flange pair 30 mounting the third leg 22 and the second flange pair 31 mounting the first leg 14. Similarly, the modified second pivot block 29*a* includes respective third and fourth flange pairs 35 and 36 pivotally mounting the respective fourth leg 24 and the second leg 16 about respective fourth leg axle 25 and the second leg second axle 21. As the respective second adjuster rod 39 is threadedly received through respective third and fourth heads 37 and 38, threaded lock nuts are mounted to each side of the third and fourth heads to position the adjuster rod in a desired spaced orientation relative to the heads. It is also understood that in the absence of the lock nuts, the first and third heads 37 and 38 may be rotated relative to the second and fourth heads respectively to provide for spacing of the heads relative to one another.

Figure 7:
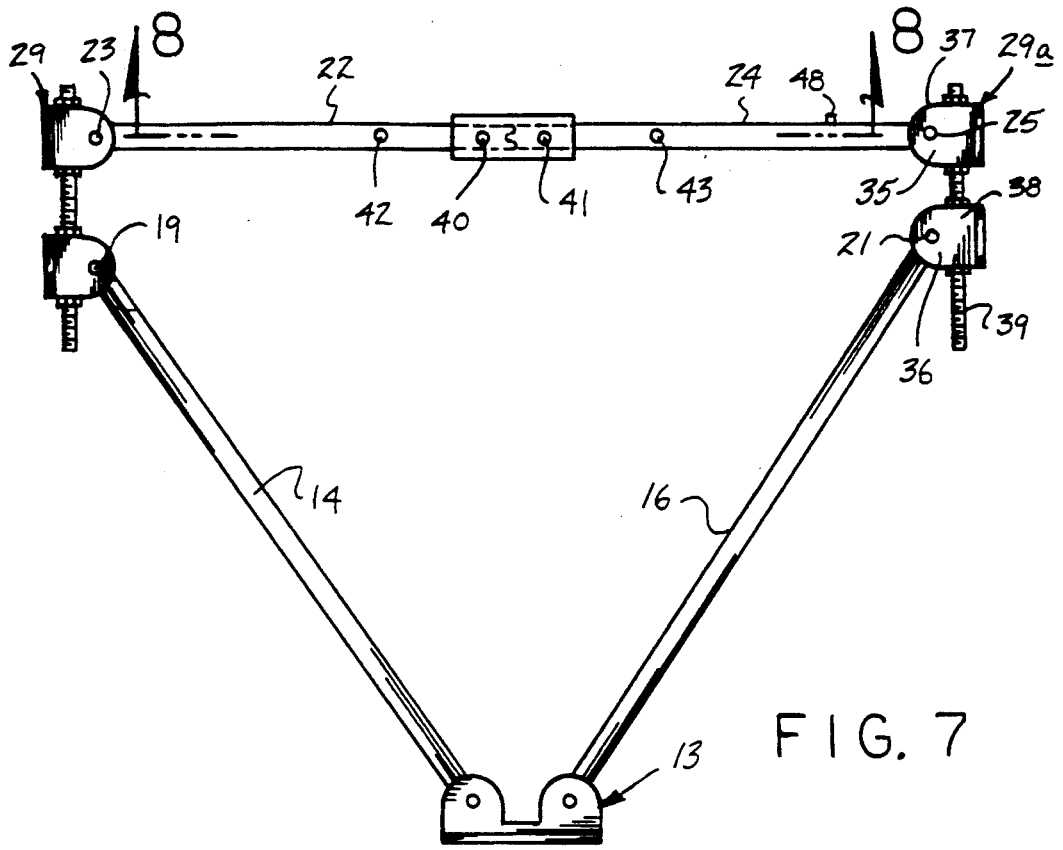
FIG. 7 is an isometric illustration of the door lock apparatus including the modified pivot block structure, as well as visual indicator of latching of the structure.
Figure 8:
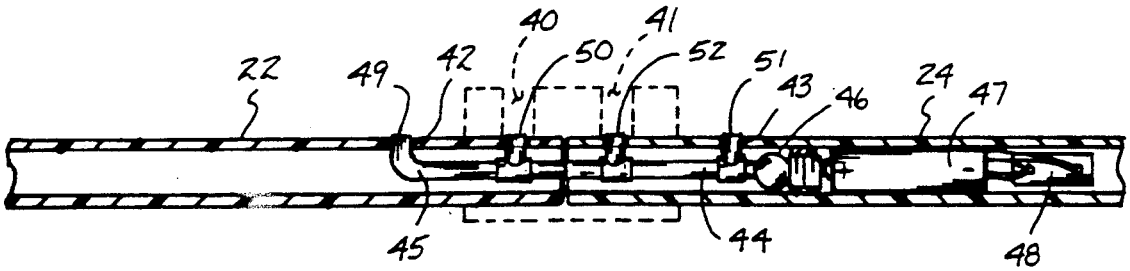
FIG. 8 is an orthographic view taken along the lines 8—8 of FIG. 7.

The FIG. 8 is arranged to indicate details of the visual illumination structure within the third and fourth legs to indicate positioning of the structure in use, as well as indicating proper interlatching of the structure, such that the slide tube 27 includes slide tube first and second bores 40 and 41 arranged for alignment with first and second fiber optic member first and second legs 49 and 50 to indicate illumination therethrough, wherein a third leg bore 42 and a fourth leg bore 43 are provided in a spaced relationship relative to the first and second fiber optic member second legs 50 and 52 projecting through the respective slide tube first and second bores 40 and 41. A first fiber optic member 44 is positioned within the fourth leg, while a second fiber optic member 45 is positioned within the third leg such that when the legs are in a latched position relative to one another, the fiber optic members 44 and 45 are aligned for directing illumination therethrough from an illumination bulb 46 directed in adjacency to the first fiber optic member 44 operative through a battery 47 and a switch 48. When the first and second fiber optic members 44 and 45 are aligned, the first and second fiber optic member first legs 49 and 51 are illuminated, as well as the first and second fiber optic member second legs 50 and 52 to indicate proper alignment and latching of the structure, in a manner as indicated in FIG. 7.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sliding door lock apparatus, comprising, a base block, and a first leg having a first leg first end and a first leg second end, a first leg first axle directed through the base block and the first leg first end and pivotally mounting the first leg relative to the base block, and a second leg having a second leg first end and a second leg second end, with a second leg first axle directed through the second leg first end and pivotally mounting the second leg to the base block, wherein the first leg first axle and the second leg first axle are arranged in a parallel relationship within the base block, and a first pivot block and a second pivot block, the first pivot block including a first leg second axle directed through the first leg second end pivotally mounting the first leg to the first pivot block, and a second leg second axle directed through the second leg second end pivotally mounting the second leg to the second pivot block, and a third leg having a third leg axle positioned within the first pivot block in parallel adjacency to the first leg second axle, including the third leg axle directed through a third leg first end, with the third leg having a third leg second end, including a bifurcated head, and a fourth leg having a fourth leg first end, including a fourth leg axle pivotally mounting the fourth leg first end to the second pivot block, with the fourth leg second end having a projecting rib receivable within the bifurcated head.

2. An apparatus as set forth in claim 1 including a slide tube slidably mounted along the fourth leg arranged for sliding and surrounding relationship of the bifurcated head and the projecting rib.

3. An apparatus as set forth in claim 2 wherein the first pivot block includes a first head and a second head, the first head includes the third leg axle directed therethrough, and the second head includes the first leg axle directed therethrough, and a first adjuster rod threadedly directed through the first head and the second head, the second pivot block includes a third head and a fourth head, with the third head pivotally mounting the fourth leg and the fourth head pivotally mounting the second leg, with a second adjuster rod threadedly directed to the third head and the fourth head.

4. An apparatus as set forth in claim 3 wherein the fourth leg includes an illumination bulb, a battery, and a switch, with the illumination bulb in electrical communication to the battery through the switch permitting selective illumination of the illumination bulb, and a first fiber optic member directed through the fourth leg extending through the projecting rib, and a second fiber optic member positioned within the third leg directed through the bifurcated head, with the first fiber optic member including a first fiber optic member first leg and a first fiber optic member second leg directed through the fourth leg and, the second fiber optic member including a second fiber optic member first leg and a second fiber optic member second leg directed through the third leg, whereupon reception of the projecting rib within the bifurcated head provides illumination through the first fiber optic member and the second fiber optic member and the first optic member first leg, the first fiber optic member second leg, the second fiber optic member first leg, and the second fiber optic member second leg.

* * * * *